United States Patent [19]

Roper

[11] 4,356,930

[45] Nov. 2, 1982

[54] CONTAINER, ENGAGEMENT RING AND COVER ASSEMBLY

[75] Inventor: Charles R. Roper, Orange, Calif.

[73] Assignees: William H. Roper; Robert E. Roper; Elvere Roper; Ralph A. Miller, all of Newport Beach, Calif. ; a part interest to each

[21] Appl. No.: 255,377

[22] Filed: Apr. 20, 1981

[51] Int. Cl.[3] ..... B65D 41/16; B65D 41/18

[52] U.S. Cl. ..... 220/306; 206/508; 220/307

[58] Field of Search ..... 220/306, 307, 256, 270; 206/508; 150/0.5; 215/321

[56] References Cited

U.S. PATENT DOCUMENTS

| | | | |
|---|---|---|---|
| 2,403,030 | 10/1944 | Solinsky | 220/306 |
| 2,885,108 | 5/1959 | Donoghue | 220/306 |
| 3,096,897 | 7/1963 | Hansen . | |
| 3,679,088 | 7/1972 | Swett et al. | 220/306 |
| 4,046,282 | 9/1977 | Ruch | 220/306 |
| 4,079,857 | 3/1978 | Crisci | 220/306 |
| 4,192,434 | 3/1980 | Conroy | 220/306 |
| 4,279,359 | 7/1981 | Jacobs | 220/306 |
| 4,288,000 | 9/1981 | Luker et al. | 220/306 |
| 4,298,134 | 11/1981 | Lewis, Jr. | 220/307 |
| 4,312,459 | 1/1982 | Leach | 220/256 |

*Primary Examiner*—George T. Hall
*Attorney, Agent, or Firm*—Mahoney & Schick

[57] ABSTRACT

An upwardly open end portion of a plastic container straight sidewall is telescoped by an inverted U-shaped portion of a plastic engagement ring with a generally transverse, outward flange on the container sidewall snap interengaging with a similar engagement ring flange. An engagement ring U-shaped portion extends transversely inwardly having, in certain embodiments, either a simple or complex outer wall common with the inverted U-shaped portion and in all cases an interior wall spaced inwardly therefrom. An edge portion of a plastic cover overlies the engagement ring U-shaped portion and has a downward extension fitting therein divided into an exterior wall outwardly abutting the ring U-shaped portion outer or common wall and a transverse inward flange snap interengaging with a similar flange on the ring interior wall. The cover edge portion terminates inwardly at an interior wall which outwardly abuts the ring U-shaped portion interior wall and a cover transverse connecting part joins the edge portion interior wall vertically intermediate both the cover edge portion interior wall and the ring U-shaped portion interior wall. In the assembly, the engagement ring and cover are constructed to exert transverse pressure outwardly to outwardly abuttingly pressure seal between the cover edge portion and the engagement ring, and between the engagement ring and the container sidewall inner side. The cover edge portion terminates outwardly in a transverse flange spaced above the engagement ring and engageable by a tool for removing the cover from the engagement ring.

64 Claims, 10 Drawing Figures

CONTAINER, ENGAGEMENT RING AND COVER ASSEMBLY

BACKGROUND OF THE INVENTION

This invention relates to a container, engagement ring and cover assembly which is constructed incorporating either one or both of two basic novel concepts, either of which particularly adapt the assembly for preferably being molded totally of plastic. According to the one novel concept, an inverted U-shaped portion of the engagement ring telescopes over an open upper end of the container sidewall with transverse interengagement between flanges thereof, and an edge portion of the cover overlies and extends downwardly into a U-shaped inward extension of the engagement ring with transverse interengagement between flanges thereof. In the other novel concept, an inverted U-shaped portion of the engagement ring telescopes an upper open end of the container sidewall positioning an engagement ring generally vertical wall outwardly abutting an inner side of the container sidewall and a generally vertical wall on the cover edge portion is positioned outwardly abutting the engagement ring wall, with the engagement ring and cover being constructed and arranged to exert an outward transverse pressure for pressure sealing between the cover and engagement ring walls and between the engagement ring wall and the container sidewall inner side.

Various forms of prior container constructions have been hereinbefore provided involving a container, engagement ring and cover assembly. Most of these particular prior constructions have been formed totally of metal, such as the usual tinplate. For instance, one of the prime examples is the common metal paint can in which paint and similar materials are commonly marketed and used.

With the usual paint can, the container thereof is usually formed with a cylindrical sidewall having a bottom wall secured thereto by means of the usual multiple-folded seam commonly used in metal containers and cans. An engagement ring is similarly multiple-fold seam secured to the upper open end of the container sidewall, the engagement ring extending transversely inwardly from the sidewall and being formed with a somewhat V-shaped annular recess spaced inwardly from the container sidewall and extending around the same. The cover has the edge portion thereof formed with a reduced size, somewhat matching V-shaped recess proportioned such that the cover edge portion recess may be press-fit forced downwardly into the engagement ring recess for thereby pressure sealing the contents of the container. Furthermore, a transversely projecting flange is formed at the periphery of the cover exposed for engagement by a tool to selectively remove the cover from its press-fit retention by the engagement ring so that container contents may be used with the cover being capable of being returned to its assembled positioning and press-fit retainment due to the metal rigidity.

Beyond the foregoing purely functional pressure sealing and containment features of the prior paint cans and similar containers, such containers are required to have certain other particulars of construction necessary for proper factory conveying and ultimate marketing. One of these is that the container sidewall must be vertically straight throughout between the upper and lower end portions thereof. One of the principal reasons for this requirement is so that labeling may be conveniently applied thereto, whether by direct printing thereon or by adhesively applied labels. If the container sidewall is other than straight, obvious difficulties are presented.

Another requirement for convenience in conveying of the containers in the manufacturing facilities during filling, closing, packing and storage, and also associated with the straight container sidewall requirement, is that the upper and lower end portions at the sidewall of the container must project transversely equal distances. In other words, once the engagement ring has been assembled with the container and both before and after the assembly of the cover, the center axis of the container must be parallel to the surface upon which it rests when the container is laying on its side. This is necessary so that the container may be conveyed by rolling the same on its side during which it must roll in a straight line.

As hereinbefore stated, most of the prior paint cans and similar containers incorporating container, engagement ring and cover assembly have been formed of metal and it has now been determined that if this type of container could be constructed so that it is adaptable to being totally molded from plastic, quite extensive cost savings and other benefits could be appreciated in the manufacturing industries making use of this type of container. However, in order to satisfactorily accomplish such conversion from total metal to total plastic, the semi-assembled and finally assembled plastic container would have to meet the exact same requirements as met by the prior metal container. To meet all of these requirements with a molded plastic container presents a multiplicity of problems which require solutions. Also, still other problems are presented purely from the standpoint of plastic molding procedures which are not present in the entirely different metal forming procedures.

Comparing the structure of the metal container of the type herein involved and the resultant molded plastic container if such conversion is made, the metal container has the bottom wall thereof multiple-fold seam connected to the lower end of the container sidewall and the engagement ring similarly seam connected to the upper end of the container sidewall. Obviously, the common multiple-fold seam used with metal containers cannot be used in a plastic container. Although with a plastic container the connection of the bottom wall with the container sidewall is not a problem since it can merely be integrally molded therewith, it does become a problem as to just how to provide a connection between the upper end of the container sidewall and the engagement ring, particularly keeping in mind that it must be a pressure sealed connection.

Furthermore, with the metal container, the engagement ring and cover are merely formed with mating V-shaped annular recesses or grooves and the cover is friction retained with the engagement ring merely by a friction fit between the mating V-shaped portions. It is again apparent that with plastic, friction retention will not suffice. Physical interengagement between the plastic cover and engagement ring must be somehow incorporated. In addition with the plastic, a second pressure sealing zone must be provided to complete the pressure sealing requirements.

Still further, one of the requirements of the metal container is that it have a vertically straight sidewall for the various reasons enumerated and this requirement presents a major difficulty in normal plastic molding processes. Most prior molded plastic containers, regardless of the other particular structure thereof, have had tapered sidewalls. The principal reason that the sidewalls are tapered is so that the container after molding can be easily removed from the mold. Here, however, we must have a straight sidewall between the sidewall end portion connections to the container bottom wall and to the upper engagement ring assembled therewith.

Furthermore, the end portion connections of the container sidewall to the container bottom wall and to the assembled engagement ring must protrude transversely equal distances so that the assembled container, whether assembled merely with the engagement ring or with both the engagement ring and cover, will roll in a straight line for the reasons hereinbefore discussed. This, therefore, again also involves the pressure sealing connection between the upper end portion of the container sidewall and the engagement ring assembled therewith so that the transverse protrusion of the assembly properly satisfies the equal distance requirement.

OBJECTS AND SUMMARY OF THE INVENTION

It is, therefore, an object of this invention to provide a container, engagement ring and cover assembly which is uniquely constructed so as to be readily adaptable for the formation of the same totally from molded plastic, if desired, while still incorporating therein one or more of various unique concepts partially or completely satisfying the manufacturing and marketing requirements of the similar, prior, totally metal assemblies such as paint cans and the like. In a preferred embodiment thereof, the container bottom wall is molded integral with the container sidewall, the engagement ring is transverse flange interengaged with the container sidewall upper end, and the cover is transverse flange interengaged with the engagement ring, thereby eliminating necessity of folded seam connections and metal-to-metal friction connections as required by the similar purely metal containers. In the same preferred embodiments, by proper preplanned dimensioning and known molding procedures, a chine or flange at the container sidewall bottom end and the engagement ring assembled with the container sidewall at the container sidewall upper end project equal distances transversely at ends of a straight sidewall so that the container assembly when positioned on its side will be supported and roll in a straight line, one of the important requirements of the similar metal container assemblies required for being properly conveyed in the manufacturing process.

It is a further object of this invention to provide a container, engagement ring and cover assembly of the foregoing general character and capable of providing the foregoing advantages wherein, in one form thereof, a unique combination of pressure sealing zones may be incorporated therein, when required, for pressure sealing the contents of a fully assembled and filled container in an equally or superior manner than with the prior metal container assemblies. Where this advantageous multiple pressure sealing concept is desired, the engagement ring is particularly configured so that an inverted U-shaped portion thereof telescopes the upper end of the container sidewall providing a wall of the engagement ring inwardly of and outwardly abutting the container sidewall. Furthermore, an outer edge portion of the cover is provided with a similar wall positioned inwardly of the engagement ring wall and outwardly abutting the same. Thus, by properly calculated formation of the cover and engagement ring, outward transverse pressure is exerted by the cover through its wall into the engagement ring wall and by the engagement ring wall into the container sidewall so as to form multiple, interacting sealing zones which pressure seal the engagement ring and cover with the container so as to pressure seal the contents of the container assembly within the container during transportation and storage.

it is still another object of this invention to provide a container, engagement ring and cover assembly wherein, in a preferred embodiment thereof, not only is the engagement ring transverse flange interengaged with the upper end of the container sidewall and the cover transverse flange interengaged with the engagement ring as hereinbefore discussed, but the interengagement between the cover and the engagement ring may be of an interfitting unique nature so as to provide positive secure retainment of the cover with the engagement ring when desired, yet permit ready removal of the cover when access to the container contents is desired. As hereinbefore pointed out, it is preferred to interengage the engagement ring with the upper end of the container sidewall by use of mating transverse flanges and these may be of relatively permanent interengaged nature, since once assembled they will remain assembled. However, the transverse flange interengagement between the engagement ring and cover which must permit selective removal of the cover is formed by constructing the engagement ring with a U-shaped portion inwardly of the container sidewall, and the cover with an edge portion which overlies the engagement ring U-shaped portion and projects downwardly therein. Still in the preferred form, the downward projection of the cover edge portion includes a part of the downward projection outwardly pressure abutting the engagement ring U-shaped portion and a part of the downward projection inwardly pressure engaging the previously described transverse interengaged flanges. The overall result is that in fully assembled position, the cover is securely retained with the engagement ring and will withstand relatively strong impact while retaining such engagement, yet by use of a tool engaged beneath a transverse flange at the periphery of the cover, the cover may be selectively removed from such engagement for complete removal of the cover from the engagement ring.

Other objects and advantages of the invention will be apparent from the following specification and the accompanying drawings which are for the purpose of illustration only.

DESCRIPTION OF THE BEST EMBODIMENTS CONTEMPLATED

Figure 1:
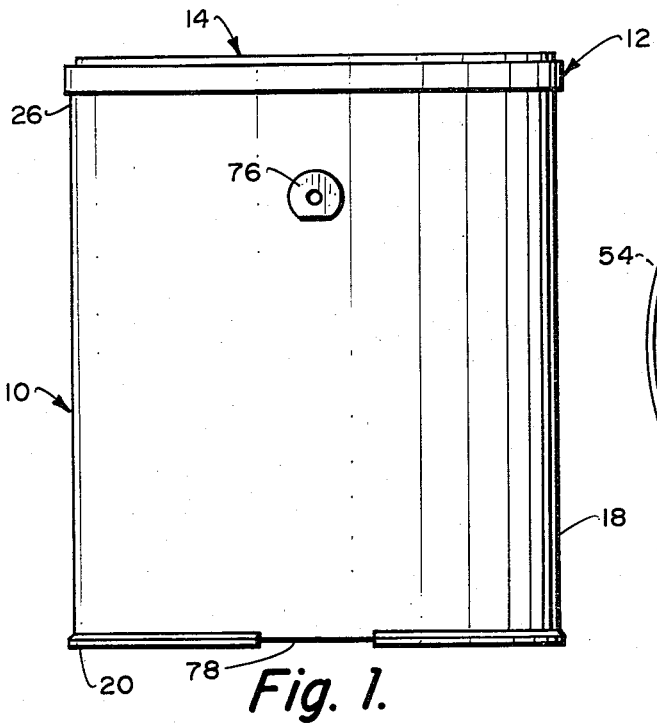
FIG. 1 is a side elevational view of a first preferred embodiment of container, engagement ring and cover assembly incorporating certain of the principles of the present invention.

Referring to FIGS. 1 through 5 of the drawings, a first preferred embodiment of container, engagement ring and cover assembly incorporating certain of the principles of the present invention includes three basic elements, a container generally indicated at 10, an engagement ring generally indicated at 12 and a cover generally indicated at 14. As will be hereinafter discussed more in detail, the container 10, engagement ring 12 and cover 14, as is also true for similar elements of other embodiments of the present invention to be hereinafter described, are all particularly adapted for being formed by injection molding the same from plastic. Furthermore, the particular plastic used for such injection molding may be any one of a series of plastics used for molding containers and the like and the molding procedures used for forming the same may be generally of usual type, all well known to those skilled in the art.

More specifically, the first embodiment container 10 includes a generally horizontally extending bottom wall 16 transversely outwardly integrally molded at the periphery thereof with an upwardly open, straight vertical sidewall 18. At the joinder thereof, a transversely outwardly and downwardly extending chine or flange 20 is integrally molded of somewhat usual form. Thus, the bottom flange 20 supports the container 10 on a normal supporting surface retaining the bottom wall 16 slightly spaced upwardly therefrom. Also, the bottom wall 16 may include an upwardly projecting, center recess 22 merely for molding purposes, and an upwardly projecting, peripheral clearance recess 24 for purposes to be hereinafter pointed out.

The container sidewall 18 terminates spaced downwardly from its upper end 26 in a downwardly facing, partially transversely recessed, generally transversely outwardly extending retainment flange 28 at an outer side 30 thereof. In specific preferred form, the retainment flange 28 extends transversely at or closely to right angles to the container sidewall 18 and preferably totally around the container sidewall. An inner side 32 of the container sidewall 18 is preferably straight merely forming a continuation of the remainder of the container sidewall.

Figure 4:
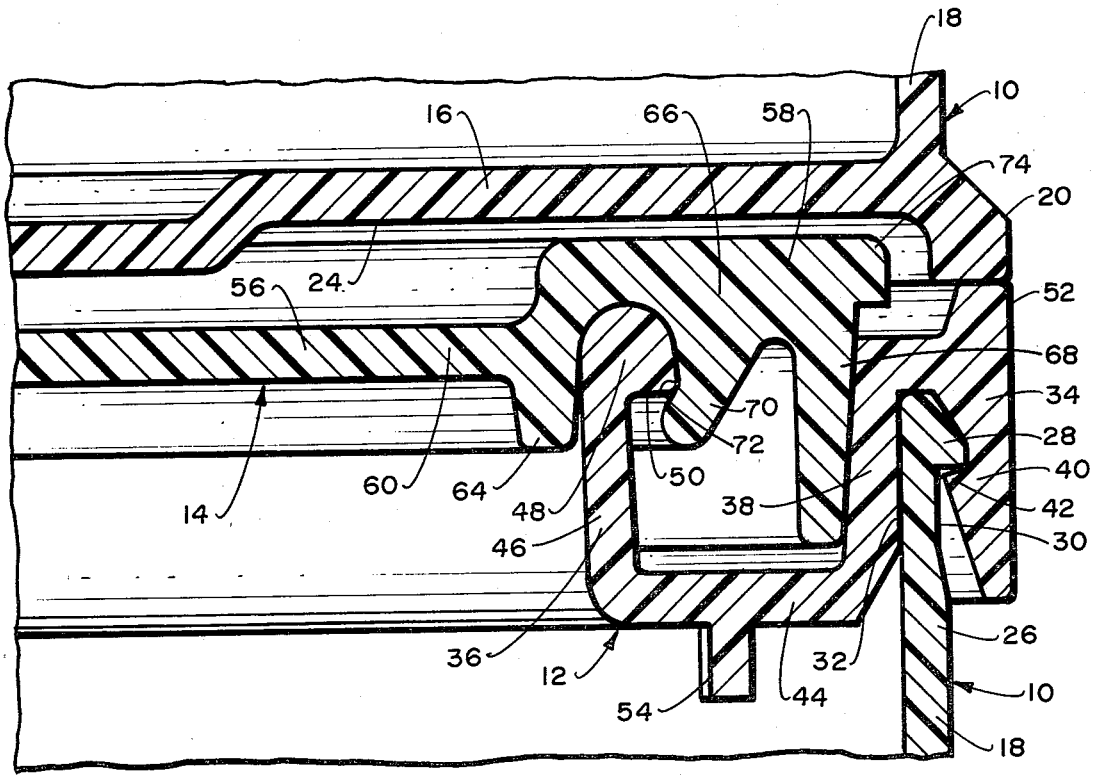
FIG. 4 is an enlarged, fragmentary, vertical sectional view taken from FIG. 3 as indicated in FIG. 3, but showing the second container, engagement ring and cover assembly stacked thereon in full, sectional lines.
Figure 5:
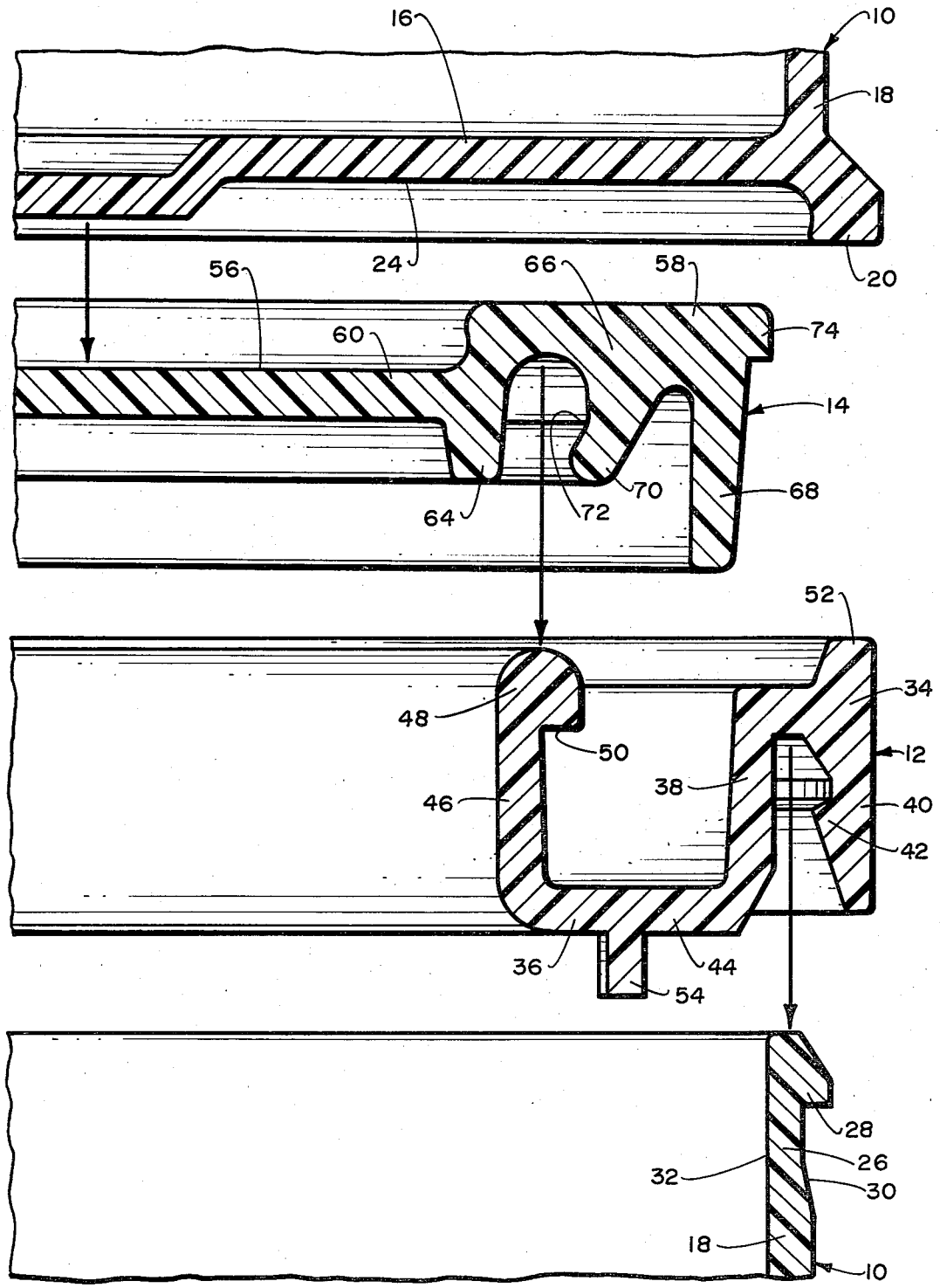
FIG. 5 is an exploded view of the assemblies of FIG. 4.

The engagement ring 12 includes an outer, inverted U-shaped portion 34 integrally joined with an inner U-shaped portion 36, the two portions being annular portions and forming a common, generally vertical wall 38 therebetween, in essence, the common wall being an inner or interior leg or wall of the inverted U-shaped portion and an outer or exterior leg or wall of the U-shaped portion. An outer or exterior leg 40 of the inverted U-shaped portion 34 spaced outwardly from the common wall 38 is formed with an inwardly projecting, generally transverse retainment flange 42 spaced upwardly from the lower termination of the exterior leg. In the preferred form shown, as best seen in FIGS. 4 and 5, the retainment flange 42 of the inverted U-shaped portion 34 is angled a few degrees slightly downwardly from straight transversely in its inward extension. Furthermore, within the confined contour of the inverted U-shaped portion 34 above the exterior leg retainment flange 42, the inner surface of the inverted U-shaped portion extends upwardly and then inwardly to the common wall 38 and then downwardly along the common wall relatively closely matching the exterior surfaces of the container sidewall 18, as shown, including a straight common wall surface against a straight sidewall surface.

Inwardly of the common wall 38, the engagement ring U-shaped portion 36 extends transversely inwardly in a bottom part 44 and ultimately into a generally vertical interior wall or leg 46 spaced inwardly from the common wall 38 and completing the U-shaped opening of the U-shaped portion 36. The U-shaped portion interior leg 46 is preferably arcuate over its upper end 48 which is of increased transverse thickness toward the common wall 38 curving downwardly and then radiused inwardly into a downwardly facing, generally transversely extending retainment flange 50. The engagement ring 12 is completed by a preferably annular, upwardly projecting stacking flange 52 at the outer upper edge thereof generally upwardly aligned with the exterior leg 40 of the inverted U-shaped portion 34, and three or more circumferentially spaced, downwardly projecting positioning lugs 54 extending downwardly from the bottom part 44 of the U-shaped portion 36, the purposes of which will be hereinafter discussed more in detail.

The cover 14 is circular in configuration and includes a preferably generally transversely extending center portion 56 peripherally outwardly integrally joined with a particularly configured, annular edge portion 58 by a connecting part 60. The cover center portion 56 may include a downwardly extending center recess 62 similar to the center recess 22 of the container bottom wall 16 and for similar molding purposes. More important, the cover center portion 56 is spaced slightly below the upward extension of the edge portion 58 throughout its extent.

The cover edge portion 58, as clearly shown in FIGS. 4 and 5, includes a generally vertical, interior wall 64 which joins the transverse cover connecting part 60 intermediate the interior wall vertical height, preferably approximately vertically midway. Spaced upwardly from the connecting part 60, the cover edge portion 58 extends transversely outwardly and is formed with a downward extension 66 preferably transversely separated into two parts, a generally vertical exterior wall 68 and a generally transversely inwardly angled flange portion 70. The downward extension flange portion 70 due to its inwardly angled projection forms a partially upwardly facing retainment flange 72 with the edge portion 58 curving arcuately upwardly therefrom and then inwardly to the interior wall 64 as shown. Finally, the cover edge portion 58 is completed by a transversely outwardly projecting, tool engagement flange 74 peripherally around the edge portion at upper termination of the downward extension exterior wall 68, also as shown.

In assembly of the container 10 and engagement ring 12, from the position shown in FIG. 5 to the position shown in FIG. 4, the inverted U-shaped portion 34 of the engagement ring is telescoped fully downwardly over the container upper end 26 during which the exterior leg 40 of the ring inverted U-shaped portion flexes outwardly and then back inwardly to transversely interengage the retainment flange 42 on the exterior leg of the ring inverted U-shaped portion securely beneath the retainment flange 28 on the container upper end 26. As shown in assembled position in FIG. 4, the container upper end 26 substantially fills the inverted U-shaped portion 34 of the engagement ring 12 at least above the interengaged flanges between the container upper end and the ring inverted U-shaped portion, and the interengagement between the retainment flanges is guite secure due to the fact that the retainment flange 28 on the container upper end 26 extends substantially straight transverse and the retainment flange 42 on the ring inverted U-shaped portion 34 extends only very slightly angled from straight transverse. Equally important, with the full telescoping of the ring inverted U-shaped portion 34 with the container upper end 26 and the described retainment flange interengagement, the ring common wall 38 between the ring inverted U-shaped and U-shaped portions 34 and 36 is positioned lying flatwise against and outwardly transversely flatwise abutting the inner side 32 of the container upper end 26 from spaced well beneath the interengaged flanges upwardly to very near the upper extremity of the container sidewall 18.

With this assembly of the container 10 and engagement ring 12 completed, the assembly is ready for filling with its intended contents, and following such filling, it is ready for the final assembly of the cover 14 therewith. Furthermore, with the preferred embodiment of the container, engagement ring and cover assembly according to the present invention, this final assembly step will involve two unique inventive concepts. One is the particular form of interengagement between the cover edge portion 58 and the U-shaped portion 36 of the engagement ring 12 to complete the enclosure of the container assembly contents, and the other is the novel pressure sealing of the container assembly contents within and merely from such assembly.

The cover 14 in this final assembly step is positioned aligned over and brought downwardly against the engagement ring 12, from the position shown in FIG. 5 to the position shown in FIG. 4. The cover edge portion 58 assumes an overlying relationship with the U-shaped portion 36 of the engagement ring 12, the interior wall 64 of the cover edge portion outwardly at least partially transversely abutting the interior leg 46 of the ring U-shaped portion and the downward extension 66 of the cover edge portion moving fully downwardly into the ring U-shaped portion. As the downward extension 66 of the cover edge portion 58 completes its downward movement relative to the ring U-shaped portion 36, the downward extension exterior wall 68 of the cover edge portion 58 comes into transverse outward flatwise abutment with the engagement ring common wall 38 over all but a small portion of the exposed vertical extent of such common wall, while at the same time, the downward extension flange portion 70 of the cover edge portion 58 partially transversely interengages inwardly beneath the interior leg retainment flange 50 of the ring U-shaped portion 36 placing the retainment flange 72 transversely interengaged beneath the retainment flange 50.

Important to both the interengagement between the engagement ring U-shaped portion 36 and the cover edge portion 58 and the pressure sealing of the entire container assembly, the cover center portion 56 is dimensioned constructed and arranged such that the cover connecting part 60 exerts direct transverse outward pressure in this final assembly against the cover edge portion 58. This results in transverse sealing pressure from the cover center portion 56 into the interior wall 64 of the cover edge portion 58 and thereby into the interior leg 46 of the ring U-shaped portion 36. Not only is the pressure sealing of the overall container assembly augmented, but transverse outward abutment pressure at this point also assists the secure interengagement between the cover edge portion and the ring U-shaped portion. The interengagement at this point is, therefore, a secure interengagement capable of withstanding impact abuse in the overall assembly while still permitting selective disengagement of the cover edge portion 58 from the engagement ring 12 due to the particular arcuate contouring and interfitting of the various parts and surfaces involved.

The exertion of the transverse outward pressure by the cover center portion 56 also results in such transverse pressure being transmitted through the cover edge portion 58 into the downward extension exterior wall 68. This causes the cover downward extension exterior wall 68 to transverse outward pressure abut and pressure seal against the engagement ring common wall 38 and the engagement ring common wall to transverse outward pressure abut and pressure seal against the inner side 36 of the container sidewall upper end 26. This pressure sealing between the container 10 and engagement ring 12 may be even further augmented, if desired, by forming the engagement ring in free standing condition a slight pressure fit with the container sidewall 18 which will additionally more securely stabilize the previously described interengagement of the retainment flanges therebetween.

Thus, in the final assembly of the first preferred embodiment of container 10, engagement ring 12 and cover 14 according to the present invention, the engagement ring is assembled with and securely transversely interengaged with the container sidewall upper end 26, and the cover edge portion 58 is assembled with and securely, but selectively removably, transversely interengaged with the engagement ring, preferably the engagement ring U-shaped portion 36 spaced inwardly from the container sidewall 18. At the same time, all three of these assembled elements are pressure sealed one with another, the cover edge portion 58 through its exterior wall 68 is pressure sealed with the engagement ring common wall 38 and the engagement ring common wall is pressure sealed with the container sidewall inner side 32 to overall pressure seal the contents of the container assembly therein. Still further, by including the pressure sealing concept in combination with the interengagement concept in the same assembly, one augments the other so that each assists the other. Such assistance is even further amplified by the possible inclusion, if desired, of the interior wall 64 of the cover edge portion 58 transversely outwardly pressure sealing against the interior leg 46 of the cover U-shaped portion 36.

As best seen in FIG. 4 in the final assembly of this first preferred embodiment of container 10, engagement ring 12 and cover 14, the tool engagement flange 74 of the cover edge portion 58 remains spaced above the upper extremities of the cover inverted U-shaped portion 34. Therefore, any time that it is desired to gain access to the contents of the container assembly, the blade of a usual tool (not shown) can be positioned beneath the tool engagement flange 74 with sufficient upward urging of the cover edge portion 58 resulting in disengagement of its transverse interengagement with the engagement ring 12. Furthermore, during this upward urging of the cover edge portion 58 by the tool, the tool outward of its engagement with the tool engagement flange 74 will bear downwardly against the engagement ring 12 so as to insure the maintaining of the engagement ring interengagement with the container upper end 26. This, of course, will result in the cover 14 moving free of the engagement ring 12 so that access to the contents is obtained, reassembly being accomplished as in the original assembly hereinbefore described.

In addition to the foregoing, the preferred embodiment of the container, engagement ring and cover assembly of the present invention is particularly adapted for meeting others of the factory and marketing requirements in manufacturing and use of the assemblies as a complete replacement for the prior totally metal constructions such as paint cans and the like. One such important requirement is that of having a vertically straight sidewall 18 on the container 10. The container 10 may be molded with a straight sidewall 18 by use of a longitudinally split mold and known molding procedures. Although mold costs are increased over those for molding the prior tapered sidewall plastic containers, such cost increases are not prohibitive and the increased benefits obtained by the present invention far outweigh the increased cost disadvantages.

Additionally, the transverse projections of the container bottom flange 20 and the engagement ring 12 assembled with the container sidewall 18 are constructed substantially identical. Thus, with the container sidewall 18 being straight vertical, the container bottom flange 20 and the engagement ring 12 will support either the container and engagement ring partial assembly or the total assembly with the cover for rolling in a straight line when positioned on its side. As previously discussed, this is an important requirement for conveying the assemblies and using the same conveying equipment as with the prior metal constructions.

Figure 2:
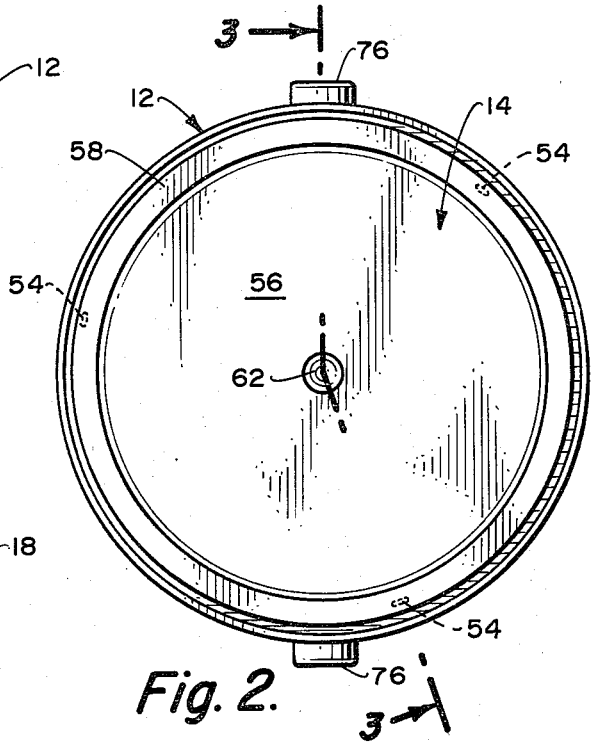
FIG. 2 is a top plan view of the container, engagement ring and cover assembly of FIG. 1.

A further feature for molding is shown in FIGS. 1 and 2. Where bail attachments, such as the bail attachments 76 are required, the container 10 is molded with a short portion of the bottom flange 20 removed in vertical alignment with the bail attachments as indicated at 78. This permits mold inserts to be used in a known manner. For similar production purposes, the positioning lugs 54 on the U-shaped portion 36 of the engagement ring 12 are provided for positioning the engagement rings both in storage before and during assembly procedure.

Figure 3:
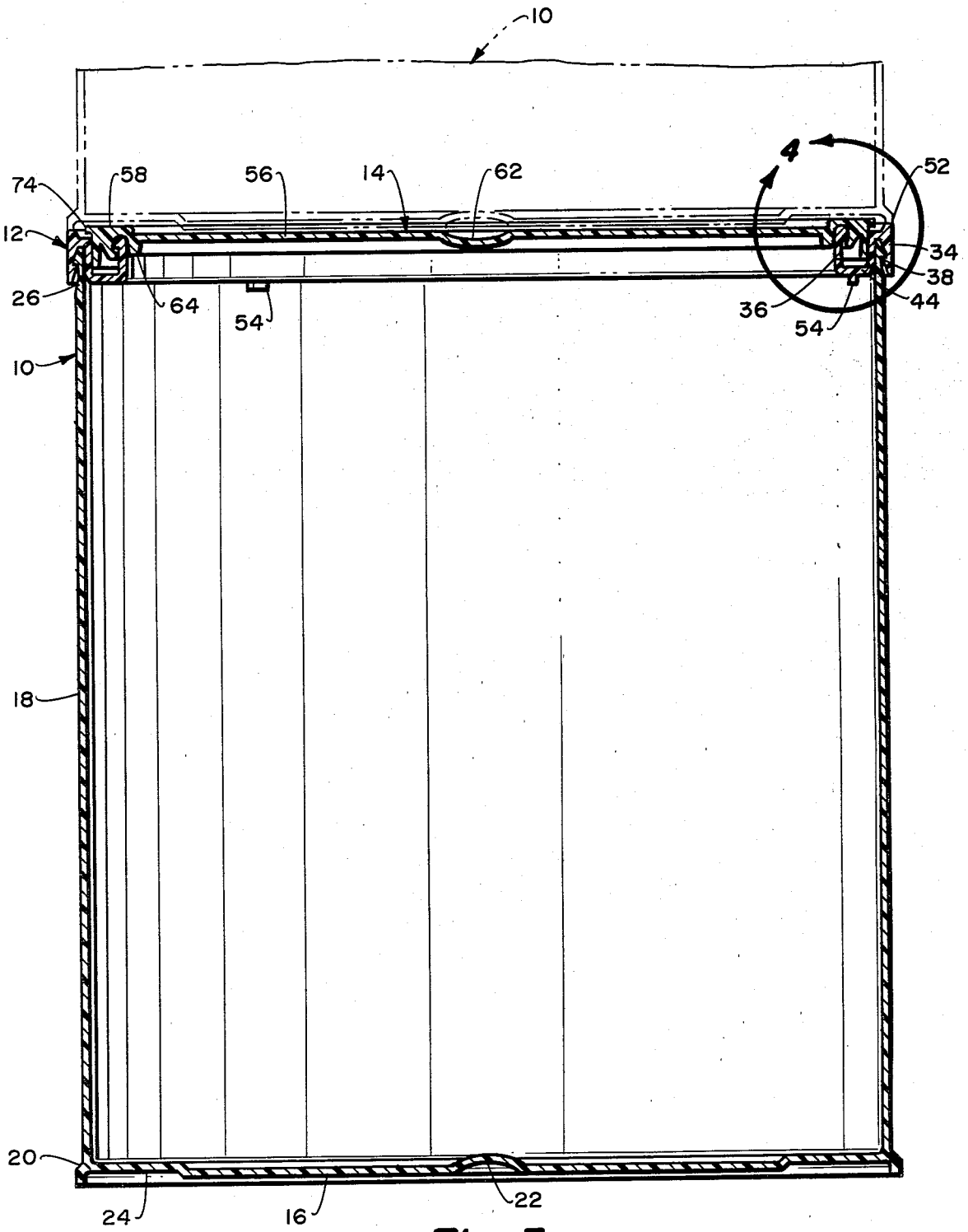
FIG. 3 is an enlarged, vertical sectional view looking in the direction of the arrows 3—3 in FIG. 2 and showing a second container, engagement ring and cover assembly in fragmentary, phantom view stacked thereon.

In order to be compatible with usual manufacturing procedures, and after assembly during storage and shipment, the container assemblies must be capable of stacking and this provision is clearly shown in phantom lines in FIG. 3 and in full lines in FIG. 4. As previously described, the container bottom wall 16 is formed with the peripheral clearance recess 24, and the bottom flange 20 at the periphery of the bottom wall 16 of the sidewall 18 projects downwardly and outwardly. Also, the engagement ring 12 is provided with the upwardly projecting stacking flange 52. Thus, one assembled container may be positioned over another and the container bottom flange 20 of the upper will rest on the engagement ring stacking flange 52 of the lower. At the same time, the peripheral clearance recess 24 of the upper container bottom wall 16 will provide clearance space for the upward projection of the cover edge portion of the lower assembly as shown, thereby permitting such nested stacking as well as radially stabilizing such stacking.

Figure 6:
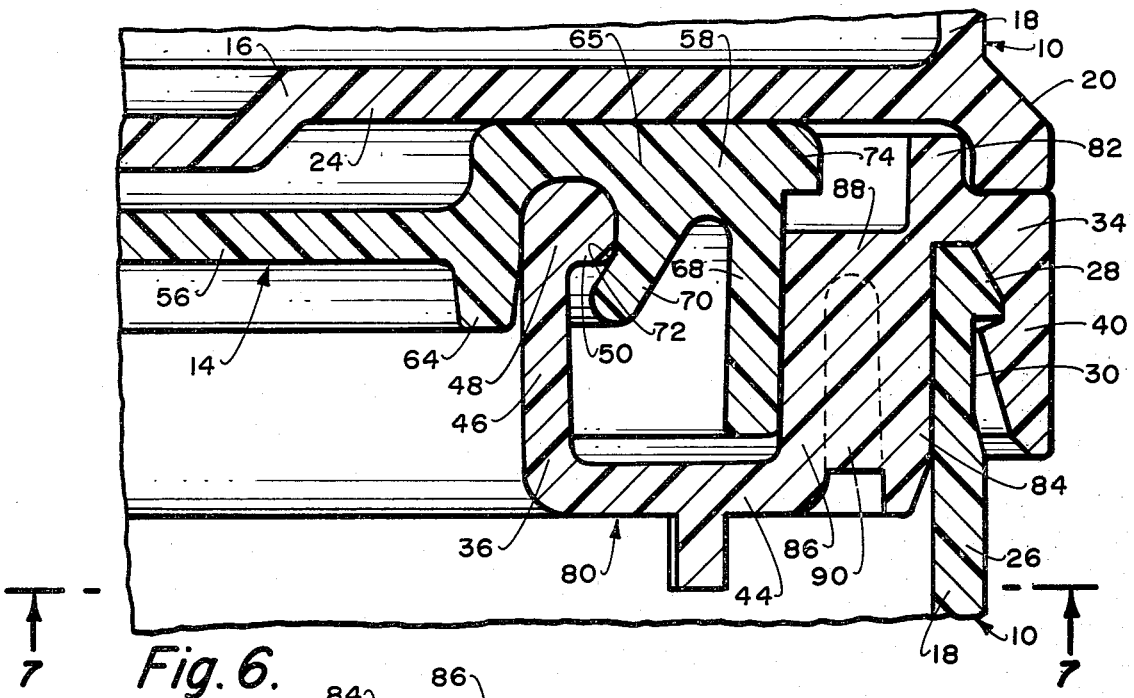
FIG. 6 is a fragmentary, vertical sectional view similar to FIG. 4, but showing a second preferred embodiment of container, engagement ring and cover assembly incorporating certain of the principles of the present invention.
Figure 7:
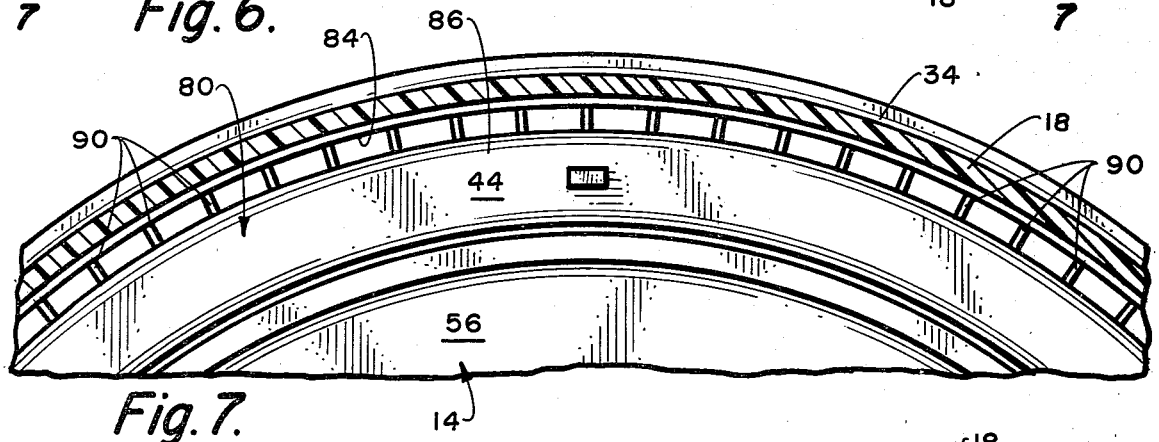
FIG. 7 is a reduced, fragmentary, horizontal sectional view looking in the direction of the arrows 7—7 in FIG. 6.

A second preferred embodiment of container, engagement ring and cover assembly incorporating certain of the principles of the present invention is shown in FIGS. 6 and 7. Specifically, the container 10 remains the same, the engagement ring is slightly altered and is generally indicated at 80, and the cover 14 remains the same except for a slight reduction in the peripheral size or horizontal extension thereof. The changes to provide the slightly altered engagement ring 80 involve changes in the inverted U-shaped and U-shaped portions 34 and 36 thereof and particularly the wall structure therebetween, as well as the location of the stacking flange thereof which is now the stacking flange 82.

As shown in FIGS. 6 and 7, the single, vertical, common wall between the inverted U-shaped and U-shaped portions 34 and 36 is replaced by an assembled common wall formed by two radially spaced, but joined, vertical walls, the interior vertical wall 84 of the inverted U-shaped portion 34 and a second wall which becomes the exterior vertical wall 86 of the U-shaped portion 36 when the U-shaped portion is provided. These two vertical walls 84 and 86 are joined spaced radially apart by an upper extremity horizontal connecting flange 88 which extends in such horizontal connection around the entire circumference of the engagement ring 80. Additionally, and equally important, the interior and exterior vertical walls 84 and 86 are radially supported and radially joined at circumferentially spaced locations completely circumferentially around the engagement ring 80 by a multiplicity of radially extending supporting ribs 90, each of which fills the major portion of the void between the interior and exterior vertical walls terminating spaced slightly above the lower extremities of such vertical walls as clearly shown.

In essence, therefore, the interior and exterior vertical walls 84 and 86 of the engagement ring 80 with their horizontal connecting flange 88 and their multiplicity of supporting ribs 90 again form what may be considered en masse the same as the previous radial pressure transferring common wall as in the first embodiment, the common wall here merely being a more complex or multiple layer common wall. The interior vertical wall 84 of the engagement ring 80 lies vertically flatwise against the inner side 32 of the container upper end 26 in assembly and the exterior wall 68 of the cover edge portion downward extension 66 lies vertically flatwise against the exterior vertical wall 86 of the engagement ring U-shaped portion 36. Radial pressure is, therefore, again transferred radially outwardly from the cover edge portion downward extension 66 into the exterior vertical wall 86 of the engagement ring U-shaped portion 36, through the horizontal connecting flange 88 and the supporting ribs 90 into the interior vertical wall 84 of the engagement ring inverted U-shaped portion 34, and finally into the container upper end 26 so as to provide the same pressure sealing effect as in the first embodiment. Otherwise, the assembly of the container 10, the engagement ring 80 and the cover 14 is precisely the same and with the cover being permitted to be of slightly less peripheral size.

The stacking flange 82 of this second embodiment assembly is relocated slightly radially inwardly as shown in FIG. 6. This permits the bottom flange 20 of a container 10 stacked thereabove to telescope thereover thereby slightly nesting therewith and being retained against radial dislocation during such stacking. As shown, the peripheral clearance recess 24 of the upper container bottom wall 16 provides sufficient clearance to receive the cover slightly raised edge portion 58 therein for additional nesting. Also, if desired for additional vertical support between the stacked assemblies, the lower cover edge portion 58 may upwardly vertically abut the upper container bottom wall 16 within the peripheral clearance recess 24.

Figure 8:
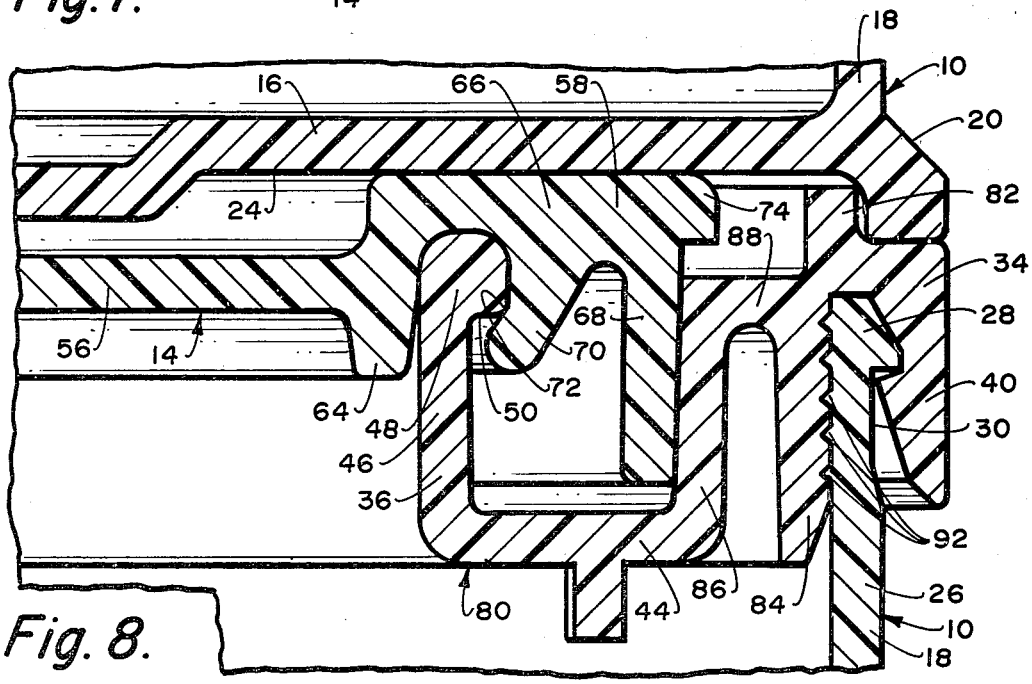
FIG. 8 is a fragmentary, vertical sectional view similar to FIG. 4, but showing a third preferred embodiment of container, engagement ring and cover assembly incorporating certain of the principles of the present invention.

In a third embodiment of container, engagement ring and cover assembly as shown in FIG. 8, the construction is virtually the same as the second embodiment with the exception of the removal of the second embodiment supporting ribs 90 and the addition of vertically spaced, peripheral serrations 92 on the interior vertical wall 84 of the engagement ring inverted U-shaped portion 34. With the removal of the supporting ribs 90, some flexing between the interior vertical wall 84 of the engagement ring inverted U-shaped portion 34 and the the second vertical wall, in this case, the exterior vertical wall 86 of the engagement ring U-shaped portion 36 may take place in the final assembly of the container 10, engagement ring 80 and cover 14, this depending on the strength and stiffness of the horizontal connecting flange 88 between these interior and exterior vertical walls. However, any reduction in pressure transference so as to slightly reduce the pressure sealing between the engagement ring 80 and the container upper end 26 can be counteracted by the peripheral serrations 92 on the engagement ring interior vertical wall 84 acting against the vertical surface of the container upper end 26. The engagement ring 80 will slightly flex at the locations of these peripheral serrations 92 to create a more positive sealing under any lesser pressure conditions.

Although in this third embodiment assembly of FIG. 8, required sealing conditions may be presented wherein serrations, such as the serrations 92, can be advantageously added, use of serrations between various surfaces for increasing pressure sealing need not be confined to the location shown either in this third embodiment or the other embodiments of the present invention. For instance, serrations could be added for increasing sealing in the first embodiment of FIG. 4 between the cover exterior wall 68 and the engagement ring common wall 38 or between the engagement ring common wall 38 and the container upper end 26. They could also be added in the second embodiment of FIG. 6 at these same general locations and similarly in the third embodiment of FIG. 8. All of this, of course, will be dependent on the particular conditions presented and what sealing assists might be required, if any.

Figure 9:
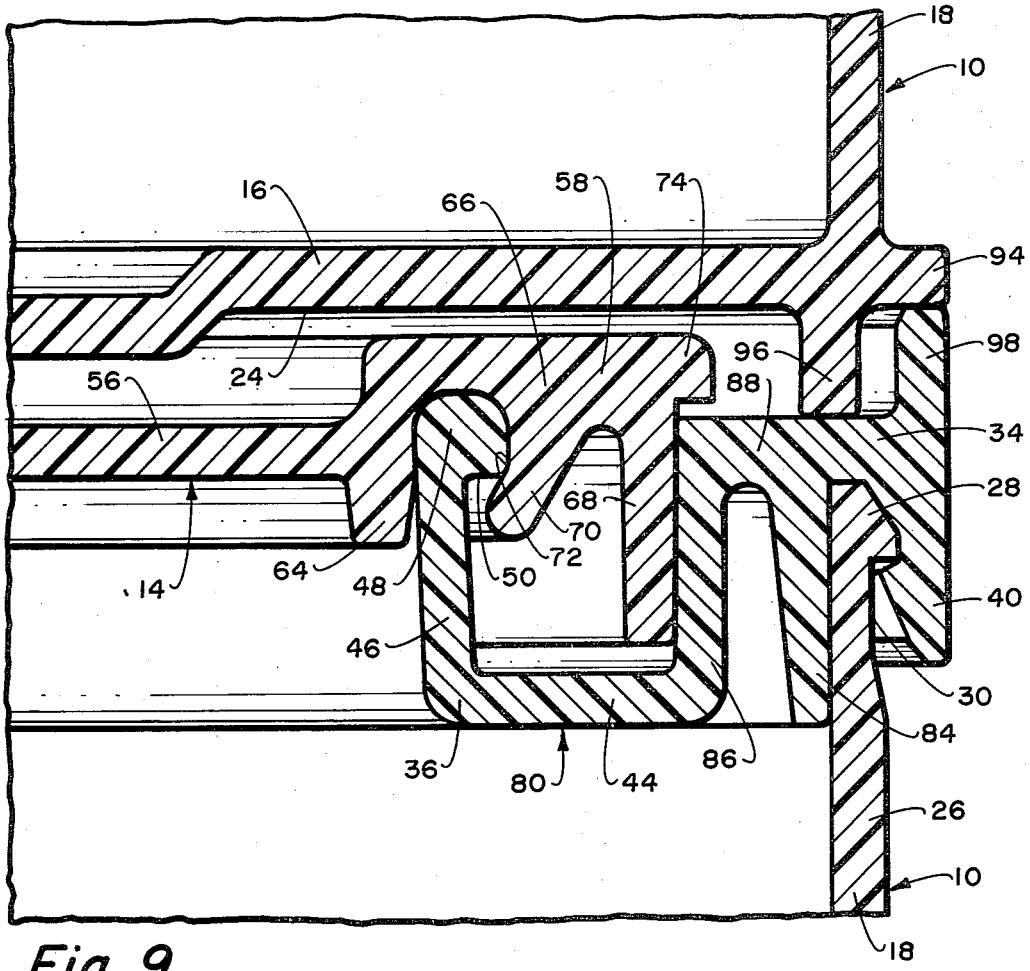
FIG. 9 is a fragmentary, vertical sectional view similar to FIG. 4, but showing a third preferred embodiment of container, engagement ring and cover assembly incorporating certain of the principles of the present invention.
Figure 10:
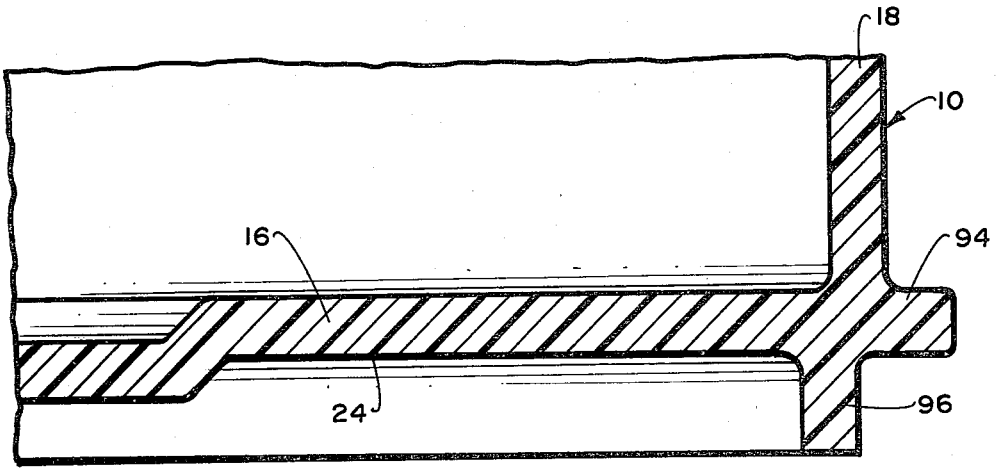
FIG. 10 is a fragmentary, vertical sectional view taken from FIG. 9 and showing the bottom corner section of the container of FIG. 9 alone.

Finally, a still further modification of the container, engagement ring and cover assembly of the present invention is shown as a fourth embodiment in FIGS. 9 and 10. This modification primarily involves a slight alteration in the bottom flange 20 of the container 10 which also requires a slight modification in the inverted U-shaped portion 34 of the engagement ring 12 of the first embodiment shown in FIGS. 1 through 5 or the engagement ring 80 of the second and third embodiments shown in FIGS. 6 and 7 or FIG. 8, respectively. As illustrated in FIGS. 9 and 10, this fourth embodiment modification is shown in the third embodiment container, engagement ring and cover assembly, but as stated, could equally well be used with either of the first or second embodiments.

Referring particularly to FIGS. 9 and 10, the single bottom flange 20 of the container sidewall 18 as shown for the first three embodiments is replaced by a substantially straight radially outwardly extending supporting flange 94 preferably radially aligned with the bottom wall 16 and a substantially straight vertically downwardly extending supporting leg 96 displaced slightly inwardly from the vertical extension of the container sidewall 18. Either of the supporting flange 94 or supporting leg 96 may extend continuously circumferentially or may be formed in circumferentially spaced segments with spaces therebetween as long as they are relatively continuous circumferentially around the container 10 to serve their supporting functions to be hereinafter described more in detail. Furthermore, due to this modification in the container 10 at the bottom wall 16 and sidewall 18 joinder, the inverted U-shaped portion 34 of the engagement ring 80 is required to be modified by moving the stacking flange thereon radially outwardly as a stacking flange 98 aligned with the periphery of the engagement ring and projecting vertically upwardly substantially equal to the downward projection of the container supporting leg 96.

In normal freestanding condition of the container 10 as shown in FIG. 10, the container when in upright position as shown will be supported on a generally horizontal surface by the supporting leg 96. Also, when the container 10 is positioned on its side while assembled with the engagement ring 80, the radial outward projection of the supporting flange 94 is constructed substantially equal to the similar projection of the engagement ring 80 from the container. Thus, the container 10 will be properly supported in upright position, and equally important, will be properly supported on its side with the sidewall 18 thereof parallel to a supporting surface so as to roll in a straight line just as with the other embodiments.

In the stacked condition as shown in FIG. 9, the supporting leg 96 of the upper container 10 nests radially within the stacking flange 98 of the engagement ring 80 on the lower container 10, the supporting flange 94 of the upper downwardly supported on the stacking flange 98 of the lower and the supporting leg 96 of the upper downwardly supported on the engagement ring 80 of the lower. The upwardly projecting edge portion 58 of the cover 14 is received partially upwardly within the peripheral clearance recess 24 of the container bottom wall 16 as before so as to permit this nested stacking. Thus, in the stacked condition, one assembly is properly supported stacked over another with the stacking flange 98 of the lower assembly aiding in preventing radial displacement therebetween due to the partially nested positioning presented.

Overall with all of the embodiments of the present invention, therefore, novel container, engagement ring and cover assemblies have been provided which are all adaptable to being molded totally of plastic, yet each is a marked improvement over the prior totally metal constructions which they may be used as an improved substitute therefor. Furthermore, the preferred embodiments thereof are each further adapted for making use of all of the prior production equipment used with the similar totally metal constructions.

Although particular embodiments of the new and novel container, engagement ring and cover assembly of the present invention have been illustrated and described herein, it is pointed out that is not intended to limit the principles of the present invention to the exact constructions shown and described herein. Rather, it is intended that the principles of the present invention be broadly construed within the specific limitations set forth in the appended claims including the patent equivalents thereof.

I claim:

1. In an assembly of a container, engagement ring and cover, the improvements including: the engagement ring having a generally inverted U-shaped portion telescoped downwardly over an open upper end of the container, said ring inverted U-shaped portion having interior wall means generally vertically and transversely abutting an inner side of said container upper end; the cover terminating transversely outwardly at said engagement ring in an edge portion at said ring inverted U-shaped portion with said edge portion having an exterior wall generally vertically and transversely abutting an inner side of said ring inverted U-shaped portion interior wall means; said engagement ring and cover being constructed and arranged exerting transverse pressure outwardly to abutting pressure seal between said cover edge portion exterior wall and ring inverted U-shaped portion interior wall means and between said ring inverted U-shaped portion interior wall means and container upper end inner side; at least partially transversely extending interengagement means between said container upper end and ring and between said ring and cover edge portion for retaining said ring against generally vertical separation from said container and said cover against generally vertical separation from said ring.

2. In an assembly as defined in claim 1 in which said interior wall means of said engagement ring inverted U-shaped portion includes a single thickness wall generally vertically and transversely abutting said inner side of said container upper end and generally vertically and transversely abutted by said edge portion exterior wall of said cover.

3. In an assembly as defined in claim 1 in which said interior wall means of said engagement ring inverted U-shaped portion includes a first generally vertical wall generally vertically and transversely abutting said inner side of said container upper end and a second vertical wall spaced transversely inwardly from said first vertical wall, said second vertical wall being transversely connected to said first vertical wall by a generally transversely extending flange, said second vertical wall being generally vertically and transversely abutted by said edge portion exterior wall of said cover.

4. In an assembly as defined in claim 1 in which said interior wall means of said engagement ring inverted U-shaped portion includes a first generally vertical wall generally vertically and transversely abutting said inner side of said container upper end and a second generally vertical wall transversely spaced inwardly from said first vertical wall, said second vertical wall being connected to said first vertical wall by a transversely extending flange and a multiplicity of generally transversely extending and circumferentially spaced ribs, said second vertical wall being generally vertically and transversely abutted by said edge portion exterior wall of said cover.

5. In an assembly as defined in claim 1 in which said engagement ring has an inner portion extending transversely inwardly and transversely inwardly spaced from said inverted U-shaped portion interior wall means, said interengagement means between said ring and cover edge portion being formed between said ring inner portion and said cover edge portion spaced transversely from said ring inverted U-shaped portion interior wall means.

6. In an assembly as defined in claim 1 in which said engagement ring has an inner portion extending transversely inwardly from said inverted U-shaped portion interior wall means, said inner portion having a generally vertically extending interior wall spaced transversely inwardly from said inverted U-shaped portion interior wall means; and in which said cover edge portion has a generally vertically extending interior wall spaced transversely inwardly from said cover edge portion exterior wall and transversely outwardly abutting said ring inner portion interior wall, said cover having a transverse connecting part integrally joined to said edge portion interior wall intermediate vertical extension of said edge portion interior wall and intermediate vertical height of said ring inner portion interior wall.

7. In an assembly as defined in claim 1 in which said engagement ring has an inner portion extending transversely inwardly from said ring inverted U-shaped portion interior wall means; in which said cover edge portion overlies said engagement ring inner portion; and in which said interengagement means between said ring and cover edge portion includes a flange on said ring inner portion interengaged with a flange on said cover edge portion.

8. In an assembly as defined in claim 1 in which said engagement ring has a U-shaped portion extending transversely inwardly from said inverted U-shaped portion, said U-shaped portion having an exterior wall common to and forming at least a part of said interior wall means of said inverted U-shaped portion, said U-shaped portion having a generally vertical interior wall spaced transversely inwardly from said common wall with said cover edge portion exterior wall abutting said common wall; in which said cover edge portion overlies said ring U-shaped portion with said cover edge portion exterior wall projecting downwardly into said abutment with said ring common wall; and in which said interengagement means between said ring and cover edge portion is between said ring U-shaped portion interior wall and said cover edge portion.

9. In an assembly as defined in claim 8 in which said exterior wall of said engagement ring U-shaped portion forms substantially the entire of said interior wall means of said inverted U-shaped portion so as to constitute a single thickness common wall common to both said inverted U-shaped and U-shaped portions, said common wall generally vertically and transversely abutting said inner side of said container upper end and being generally vertically and transversely abutted by said edge portion exterior wall of said cover.

10. In an assembly as defined in claim 8 in which said interior wall means of said engagement ring inverted U-shaped portion includes a first generally vertical wall generally vertically and transversely abutting said inner side of said container upper end and said exterior wall of said U-shaped portion forming a second vertical wall spaced transversely inwardly from said first vertical wall, said second vertical wall being transversely connected to said first vertical wall by a generally transversely extending flange so that said first and second vertical walls are functionally a common wall, said second vertical wall being generally vertically and transversely abutted by said edge portion exterior wall of said cover.

11. In an assembly as defined in claim 8 in which said interior wall means of said engagement ring inverted U-shaped portion includes a first generally vertical wall generally vertically and transversely abutting said inner side of said container upper end and said exterior wall of said U-shaped portion forming a second generally vertical wall transversely spaced inwardly from said first vertical wall, said second vertical wall being connected to said first vertical wall by a transversely extending flange and a multiplicity of generally transversely extending and circumferentially spaced ribs so that said first and second vertical walls functionally form a common wall, said second vertical wall being generally vertically and transversely abutted by said edge portion exterior wall of said cover.

12. In an assembly as defined in claim 1 in which said engagement ring has a U-shaped portion extending transversely inwardly from said inverted U-shaped portion, said U-shaped portion having an exterior wall common to said interior wall means of said inverted U-shaped portion, said U-shaped portion having a generally vertical interior wall spaced transversely inwardly from said common wall and said cover edge portion exterior wall abutting said common wall; in which said cover edge portion overlies said ring U-shaped portion with said cover edge portion exterior wall projecting downwardly into said abutment with said ring common wall; and in which said interengagement means between said ring and cover edge portion includes a transversely outwardly projecting flange on said interior wall of said ring U-shaped portion interengaged with a downwardly and transversely inwardly projecting flange on said cover edge portion.

13. In an assembly as defined in claim 1 in which said engagement ring has a U-shaped portion extending transversely inwardly from said inverted U-shaped portion, said U-shaped portion having an exterior wall common to said interior wall means of said inverted U-shaped portion, said U-shaped portion having a generally vertical interior wall spaced transversely inwardly from said common wall with said cover edge portion exterior wall abutting said common wall; in which said cover edge portion overlies said ring U-shaped portion with said cover edge portion exterior wall projecting downwardly into said abutment with said ring common wall; in which said interengagement means between said ring and cover edge portion is between said ring U-shaped portion interior wall and said cover edge portion; and in which said cover edge portion includes an interior wall extending generally vertically downwardly inwardly adjacent and transversely outwardly abutting said interior wall of said ring U-shaped portion, said cover having a generally transversely extending connecting portion terminating transversely outwardly joining said cover edge portion interior wall spaced downwardly from upper termination of said interior wall of said cover U-shaped portion.

14. In an assembly as defined in claim 1 in which said engagement ring has a U-shaped portion extending transversely inwardly from said inverted U-shaped portion, said U-shaped portion having an exterior wall common to said interior wall means of said inverted U-shaped portion, said U-shaped portion having a generally vertical interior wall spaced transversely inwardly from said common wall with said cover edge portion exterior wall abutting said common wall; in which said cover edge portion overlies said ring U-shaped portion with said cover edge portion exterior wall projecting downwardly into said abutment with said ring common wall; in which said interengagement means between said ring and cover edge portion includes a transversely outwardly projecting flange on said interior wall of said ring U-shaped portion interengaged with a downwardly and transversely inwardly projecting flange on said cover edge portion inwardly of said cover edge portion exterior wall; and in which said cover edge portion includes an interior wall extending generally vertically downwardly inwardly adjacent and transversely outwardly abutting said interior wall of said ring U-shaped portion, said cover having a generally transversely extending connecting portion terminating transversely outwardly joining said cover edge portion interior wall spaced downwardly from upper termination of said interior wall of said cover U-shaped portion.

15. In an assembly as defined in claim 14 in which said interior wall of said cover edge portion extends downwardly along said interior wall of said ring U-shaped portion to spaced downwardly of said cover connecting portion.

16. In an assembly as defined in claim 14 in which said cover edge portion terminates transversely outwardly in transversely projecting flange means spaced above and partially overlying said engagement ring exposed for engagement by a tool for selective removal of said cover from interengagement with said ring.

17. In an assembly as defined in claim 1 in which said cover edge portion terminates transversely outwardly spaced above said inverted U-shaped portion of said engagement ring in outwardly projecting flange means exposed for selective engagement by a tool to move said cover edge portion upwardly relative to said engagement ring and from said interengagement means retainment with said ring.

18. In an assembly as defined in claim 1 in which said container, engagement ring and cover are formed of plastic.

19. In a container, engagement ring and cover combination, the improvements including: a tubular sidewall on the container terminating upwardly in an open end having a generally transversely projecting flange spaced downwardly from an end surface; the engagement ring terminating transversely outwardly in an inverted U-shaped portion having a generally transversely projecting flange on a wall thereof and inwardly in a U-shaped portion having a generally transversely projecting flange on an inner wall thereof, said engagement ring having said outward inverted U-shaped portion downwardly telescoping said container sidewall with said inverted U-shaped portion flange engaged beneath said container sidewall flange; the cover having a central wall portion terminating transversely outwardly at said engagement ring in an edge portion overlying said engagement ring U-shaped portion with an edge portion downward extension received in said engagement ring U-shaped portion, said cover edge portion including a generally transverse flange engaged beneath said ring U-shaped portion inner wall flange.

20. In an assembly as defined in claim 19 in which said container, engagement ring and cover are formed of plastic.

21. In an assembly as defined in claim 19 in which said cover edge portion terminates outwardly in flange means spaced above said engagement ring and exposed for selective engagement by a tool to move said cover edge portion upwardly and disengage said cover edge portion flange from said ring U-shaped portion inner wall flange.

22. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means.

23. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means, said cover central wall portion being constructed and arranged exerting transverse pressure outwardly through said exterior wall of said edge portion downward extension into said engagement ring common wall means and from said engagement ring common wall means into said container sidewall to pressure seal said cover with said engagement ring and said engagement ring with said container.

24. In an assembly as defined in claim 23 in which said engagement ring common wall means between said inverted U-shaped and U-shaped portions is a single thickness common wall outwardly abutting said inner side of said container sidewall and inwardly abutted by said exterior wall of said cover edge portion downward extension.

25. In an assembly as defined in claim 23 in which said engagement ring common wall means between said inverted U-shaped and U-shaped portions includes an interior wall of said inverted U-shaped portion and an exterior wall of said U-shaped portion, said exterior wall of said U-shaped portion being spaced inwardly from said interior wall of said inverted U-shaped portion and being connected thereto by a transversely extending flange, said inverted U-shaped portion interior wall abutting an inner side of said container sidewall and said U-shaped portion exterior wall being abutted by said exterior wall of said cover edge portion downward extension.

26. In an assembly as defined in claim 23 in which said engagement ring common wall means between said inverted U-shaped and U-shaped portions includes an interior wall of said inverted U-shaped portion and an exterior wall of said U-shaped portion, said exterior wall of said U-shaped portion being spaced inwardly from said interior wall of said inverted U-shaped portion and being connected thereto by a transversely extending flange and a multiplicity of circumferentially spaced and radially extending ribs, said inverted U-shaped portion interior wall abutting an inner side of said container sidewall and said U-shaped portion exterior wall being abutted by said exterior wall of said cover edge portion downward extension.

27. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means, said cover edge portion terminating inwardly at an inner side of said ring U-shaped portion inner wall in an interior wall extending generally vertically and outwardly transversely abutting said ring U-shaped portion inner wall, said cover central wall portion being constructed and arranged exerting transverse pressure outwardly through said interior wall into said ring U-shaped portion inner wall to pressure seal said cover with said engagement ring, said cover central wall portion also being constructed and arranged exerting transverse pressure outwardly through said exterior wall of said edge portion downward extension into said engagement ring common wall means and from said engagement ring common wall means into said container sidewall to pressure seal said cover with said engagement ring and said engagement ring with said container.

28. In an assembly as defined in claim 19 in which said cover edge portion terminates inwardly at said cover central wall portion in an interior wall extending generally vertically and outwardly transversely abutting an inner side of said ring U-shaped portion inner wall.

29. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means, said cover edge portion terminating inwardly at said central wall portion in an interior wall extending generally vertically and outwardly transversely abutting an inner side of said ring U-shaped portion inner wall.

30. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means, said cover edge portion downward extension also including said generally transverse flange of said cover edge portion with said flange being engaged inwardly beneath said ring U-shaped portion inner wall flange.

31. In an assembly as defined in claim 19 in which said engagement ring inverted U-shaped and U-shaped portions form common wall means therebetween projecting generally vertically and abutting an inner side of said container sidewall; and in which said cover edge portion downward extension includes an exterior wall extending generally vertically and outwardly transversely abutting said engagement ring common wall means, said cover edge portion downward extension also including said generally transverse flange of said cover edge portion with said flange being engaged inwardly beneath said ring U-shaped portion inner wall flange, said cover central wall portion being constructed and arranged exerting transverse pressure outwardly through said exterior wall of said edge portion downward extension into said engagement ring common wall means and from said engagement ring common wall means into said container sidewall to pressure seal said cover with said engagement ring and said engagement ring with said container.

32. In an assembly as defined in claim 19 in which said engagement ring inverted U-shaped and U-shaped portions form common wall means therebetween projecting generally vertically and abutting an inner side of said container sidewall; in which said cover edge portion downward extension includes an exterior wall extending generally vertically and outwardly transversely abutting said engagement ring common wall means, said cover edge portion downward extension also including said generally transverse flange of said cover edge portion with said flange being engaged inwardly beneath said ring U-shaped portion inner wall flange, said cover central wall portion being constructed and arranged exerting transverse pressure outwardly through said exterior wall of said edge portion downward extension into said engagement ring common wall means and from said engagement ring common wall means into said container sidewall to pressure seal said cover with said engagement ring and said engagement ring with said container; and in which said cover edge portion terminates outwardly in flange means spaced above said engagement ring and exposed for selective engagement by a tool to move said cover edge portion upwardly and disengage said cover edge portion flange from said ring U-shaped portion inner wall flange.

33. In an assembly as defined in claim 19 in which said engagement ring inverted U-shaped and U-shaped portions form common wall means therebetween projecting generally vertically and abutting an inner side of said container sidewall; in which said cover edge portion downward extension includes an exterior wall extending generally vertically and outwardly transversely abutting said engagement ring common wall means, said cover edge portion downward extension also including said generally transverse flange of said cover edge portion with said flange being engaged inwardly beneath said ring U-shaped portion inner wall flange, said cover central wall portion being constructed and arranged exerting transverse pressure outwardly through said exterior wall of said edge portion downward extension into said engagement ring common wall means and from said engagement ring common wall means into said container sidewall to pressure seal said cover with said engagement ring and said engagement ring with said container; in which said cover edge portion terminates outwardly in flange means spaced above said engagement ring and exposed for selective engagement by a tool to move said cover edge portion upwardly and disengage said cover edge portion flange from said ring U-shaped portion inner wall flange; and in which said container, engagement ring and cover are formed of plastic.

34. In a method of assembling a container and cover, the steps of: telescoping an engagement ring downwardly over an upper edge portion of an upwardly open container sidewall; during said engagement ring telescoping, transversely interengaging a generally upwardly facing flange of said engagement ring beneath a generally downwardly facing flange of said container sidewall to resist generally vertical separation of said engagement ring from said container sidewall; inserting a cover downwardly with an edge portion thereof moved into contact with said engagement ring; during said cover insertion, transversely interengaging a generally upwardly facing flange of said cover edge portion beneath a generally downwardly facing flange of said engagement ring to resist generally vertical separation of said cover edge portion from said engagement ring.

35. In a method as defined in claim 34 in which said method includes the further steps of: during said engagement ring telescoping, positioning a wall of said ring outwardly generally vertically and transversely abutting an inner side of said container sidewall; during said cover insertion, positioning a wall of said cover edge portion outwardly generally vertically and transversely abutting an inner side of an engagement ring wall.

36. In a method as defined in claim 34 in which said method includes the further steps of: during said engagement ring telescoping, positioning a single thickness wall of said ring outwardly generally vertically and transversely abutting an inner side of said container sidewall; during said cover insertion, positioning a wall of said cover edge portion outwardly generally vertically and transversely abutting an inner side of said single thickness wall of said engagement ring.

37. In a method as defined in claim 34 in which said method includes the further steps of: during said engagement ring telescoping, positioning a first wall of said ring outwardly generally vertically and transversely abutting an inner side of said container sidewall; during said cover insertion, positioning a wall of said cover edge portion outwardly generally vertically and transversely abutting an inner side of a second wall of said engagement ring spaced transversely inwardly of said first wall and connected to said first wall by transverse flange means.

38. In a method as defined in claim 34 in which said method includes the further steps of: during said engagement ring telescoping, positioning a first wall of said ring outwardly generally vertically and transversely abutting an inner side of said container sidewall; during said cover insertion, positioning a wall of said cover edge portion outwardly generally vertically and transversely abutting an inner side of a second wall of said engagement ring spaced transversely inwardly of said first wall and connected to said first wall be transverse flange means and circumferentially spaced transverse rib means.

39. In a method as defined in claim 34 in which said method includes the further steps of: during said engagement ring telescoping, positioning a wall of said ring outwardly generally vertically and transversely abutting an inner side of said container sidewall; during said cover insertion, positioning a wall of said cover edge portion outwardly generally vertically and transversely abutting an inner side of an engagement ring wall; during and after said engagement ring telescoping and said cover insertion and due to the inherent structures thereof, exerting continuous generally transverse outward sealing pressure by said cover edge portion wall against said abutted engagement ring wall and by said abutting engagement ring wall against said container sidewall.

40. In a method as defined in claim 34 in which said method includes the further steps of: during said engagement ring telescoping, positioning a single thickness wall of said ring outwardly generally vertically and transversely abutting an inner side of said container sidewall; during said cover insertion, positioning a wall of said cover edge portion outwardly generally vertically and transversely abutting an inner side of said single thickness wall of said engagement ring; during and after said engagement ring telescoping and said cover insertion and due to the inherent structures thereof, exerting continuous generally transverse outward sealing pressure by said cover edge portion wall against said engagement ring single thickness wall and by said engagement ring single thickness wall against said container sidewall.

41. In a method as defined in claim 34 in which said method includes the further steps of: during said engagement ring telescoping, positioning a first wall of said ring outwardly generally vertically and transversely abutting an inner side of said container sidewall; during said cover insertion, positioning a wall of said cover edge portion outwardly generally vertically and transversely abutting an inner side of an engagement ring second wall transversely spaced from said first wall and connected thereto by flange means; during and after said engagement ring telescoping and said cover insertion and due to the inherent structures thereof, exerting continuous generally transverse outwardly sealing pressure by said cover edge portion wall against said engagement ring second wall and by said engagement ring first wall against said container sidewall.

42. In a method as defined in claim 34 in which said method includes the further steps of: during said engagement ring telescoping, positioning a first wall of said ring outwardly generally vertically and transversely abutting an inner side of said container sidewall; during said cover insertion, positioning a wall of said cover edge portion outwardly generally vertically and transversely abutting an inner side of a second wall of said engagement ring spaced transversely from said first wall and transversely connected thereto by flange means and circumferentially spaced transverse rib means; during and after said engagement ring telescoping and said cover insertion and due to the inherent structures thereof, exerting continuous generally transverse outward sealing pressure by said cover edge portion wall against said engagement ring second wall and by said engagement ring first wall against said container sidewall.

43. In a method as defined in claim 34 in which said method includes the further steps of: during said engagement ring telescoping, positioning a wall of said ring outwardly generally vertically and transversely abutting an inner said container sidewall; during said cover insertion, positioning a wall of said cover edge portion outwardly generally vertically and transversely abutting an inner side of an engagement ring wall; during and after said engagement ring telescoping and said cover insertion, positioning a cover central wall portion exerting a continuous generally transverse outward pressure against said cover edge portion to exert a generally transverse outward sealing pressure by said cover edge portion wall against said abutted engagement ring wall and by said abutting engagement ring wall against said container sidewall.

44. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; and in which said step of inserting a cover includes positioning said cover edge portion overlying said engagement ring U-shaped portion and inserting a part of said cover edge portion downwardly into said engagement ring U-shaped portion.

45. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part insertion, positioning a wall of said cover edge portion part outwardly generally vertically and transversely abutting an inner side of a wall of said engagement ring inverted U-shaped portion.

46. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part outwardly generally vertically and transversely abutting an inner side of a wall of said engagement ring U-shaped portion; during and after said engagement ring inverted U-shaped portion telescoping and said cover edge portion part insertion and due to the inherent structures thereof, exerting continuous generally transverse outward sealing pressure by said cover edge portion part wall against said abutted engagement ring U-shaped portion wall and by said abutting engagement ring inverted U-shaped portion wall against said inner side of said container sidewall.

47. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part outwardly generally vertically and transversely abutting an inner side of a wall of said engagement ring U-shaped portion; during and after said engagement ring inverted U-shaped portion telescoping and said cover edge portion part insertion, positioning a cover central wall portion exerting a continuous generally transverse outward pressure against said cover edge portion part wall to exert a generally transverse outward sealing pressure by said cover edge portion part wall against said abutted engagement ring U-shaped portion wall and by said abutting engagement ring inverted U-shaped portion wall against said inner side of said container sidewall.

48. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion; and in which said step of during said cover insertion, transversely interengaging said flange of said cover edge portion beneath said flange of said engagement ring includes transversely interengaging said flange of said cover edge portion beneath said flange on an inner leg of said engagement ring U-shaped portion.

49. In a method as defined in claim 34 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part outwardly generally vertically and transversely abutting an inner side of a wall of said engagement ring U-shaped portion, positioning an interior wall of said cover edge portion spaced inwardly from said cover edge portion part generally vertically and transversely abutting an inner side of an engagement ring U-shaped portion inner leg.

50. In a method as defined in claim 49 in which said method includes the further step of: during and after said engagement ring telescoping and said cover insertion, positioning a cover central wall portion exerting a continuous generally transverse outward pressure against said cover edge portion to exert a generally transverse outward sealing pressure by said cover edge portion interior wall against said engagement ring U-shaped portion inner leg and by said cover edge portion part wall against said abutted engagement ring U-shaped portion wall and by said abutting engagement ring inverted U-shaped portion wall against said container sidewall inner side.

51. In a method as defined in claim 34 in which said method includes the further step of: during said cover insertion, positioning a cover release flange located at an outer termination of said cover edge portion spaced above said engagement ring accessible by a tool to selectively release said cover edge portion from said flange interengagement with said engagement ring.

52. In a method as defined in claim 34 in which said method includes the further step of: forming each of said container, engagement ring and cover of plastic.

53. In a method as defined in claim 34 in which said method includes the further steps of: during said engagement ring telescoping, positioning a wall of said ring outwardly generally vertically and transversely abutting an inner side of said container sidewall; during said cover insertion, positioning a wall of said cover edge portion outwardly generally vertically and transversely abutting an inner side of an engagement ring wall; during said cover insertion, positioning a cover release flange located at an outer termination of said cover edge portion spaced above said engagement ring accessible by a tool to selectively release said cover edge portion from said interengagement with said engagement ring.

54. In a method as defined in claim 34 in which said method includes the further steps of: during said engagement ring telescoping, positioning a wall of said ring outwardly generally vertically and transversely abutting an inner side of said container sidewall; during said cover insertion, positioning a wall of said cover edge portion outwardly generally vertically and transversely abutting an inner side of an engagement ring wall; during and after said engagement ring telescoping and said cover insertion, positioning a cover central wall portion exerting a continuous generally transverse outward pressure against said cover edge portion to exert a generally transverse outward sealing pressure by said cover edge portion wall against said abutted engagement ring wall and by said abutting engagement ring wall against said container sidewall during said cover insertion, positioning a cover release flange located at an outer termination of said cover edge portion spaced above said engagement ring accessible by a tool to selectively release said cover edge portion from said interengagement with said engagement ring.

55. In a method of assembling a container and cover, the steps of: telescoping an engagement ring downwardly over an upper edge portion of an upwardly open container sidewall; during said engagement ring telescoping, positioning a wall of said ring outwardly generally vertically and transversely abutting an inner side of said container sidewall; during said engagement ring telescoping, interengaging said engagement ring with said container sidewall to resist generally vertical separation of said engagement ring from said container sidewall; inserting a cover downwardly with an edge portion thereof moved into contact with said engagement ring; during said cover insertion, positioning a wall of said cover edge portion outwardly generally vertically and transversely abutting an inner side of an engagement ring wall; during said cover insertion, interengaging said cover edge portion with said engagement ring to resist generally vertical separation of said cover edge portion from said engagement ring; during and after said engagement ring telescoping and said cover insertion and due to the inherent structures thereof, exerting continuous generally transverse outward sealing pressure by said cover edge portion wall against said abutted engagement ring wall and by said abutting engagement ring wall against said container sidewall.

56. In a method as defined in claim 55 in which said method includes the further steps of: during said engagement ring telescoping, positioning said ring wall as a single thickness wall of said ring outwardly generally vertically and transversely abutting an inner side of said container sidewall; during said cover insertion, positioning said wall of said cover edge portion outwardly generally vertically and transversely abutting an inner side of said single thickness wall of said engagement ring; during and after said engagement ring telescoping and said cover insertion and due to the inherent structures thereof, exerting continuous generally transverse outward sealing pressure by said cover edge portion wall against said engagement ring single thickness wall and by said engagement ring single thickness wall against said container sidewall.

57. In a method as defined in claim 55 in which said method includes the further steps of: during said engagement ring telescoping, positioning said ring wall as a first wall of said ring outwardly generally vertically and transversely abutting an inner side of said container sidewall; during said cover insertion, positioning said wall of said cover edge portion outwardly generally vertically and transversely abutting an inner side of an engagement ring second wall transversely spaced from said first wall and connected thereto by flange means; during and after said engagement ring telescoping and said cover insertion and due to the inherent structures thereof, exerting continuous generally transverse outwardly sealing pressure by said cover edge portion wall against said engagement ring second wall and by said engagement ring first wall against said container sidewall.

58. In a method as defined in claim 55 in which said method includes the further steps of: during said engagement ring telescoping, positioning said ring wall as a first wall of said ring outwardly generally vertically and transversely abutting an inner side of said container sidewall; during said cover insertion, positioning said wall of said cover edge portion outwardly generally vertically and transversely abutting an inner side of a second wall of said engagement ring spaced transversely from said first wall and transversely connected thereto by flange means and circumferentially spaced transverse rib means; during and after said engagement ring telescoping and said cover insertion and due to the inherent structures thereof, exerting continuous generally transverse outward sealing pressure by said cover edge portion wall against said engagement ring second wall and by said engagement ring first wall against said container sidewall.

59. In a method as defined in claim 55 in which said method includes the further step of: during and after said engagement ring telescoping and said cover insertion, positioning a cover central wall portion exerting a continuous generally transverse outward pressure against said cover edge portion to exert a generally transverse outward sealing pressure by said cover edge portion wall against said abutted engagement ring wall and by said abutting engagement ring wall against said container sidewall.

60. In a method as defined in claim 55 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part outwardly generally vertically and transversely abutting an inner side of a wall of said engagement ring U-shaped portion; during and after said engagement ring inverted U-shaped portion telescoping and said cover edge portion part insertion and due to the inherent structures thereof, exerting continuous generally transverse outward sealing pressure by said cover edge portion part wall against said abutted engagement ring U-shaped portion wall and by said abutting engagement ring inverted U-shaped portion wall against said inner side of said container sidewall.

61. In a method as defined in claim 55 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion and inserting a part of said cover edge portion downwardly into said engagement ring U-shaped portion; and in which said method includes the further steps of: during said engagement ring inverted U-shaped portion telescoping, positioning a wall of said ring inverted U-shaped portion outwardly generally vertically and transversely abutting an inner side of said container sidewall; during said cover edge portion part insertion, positioning a wall of said cover edge portion part outwardly generally vertically and transversely abutting an inner side of a wall of said engagement ring U-shaped portion; during and after said engagement ring inverted U-shaped portion telescoping and said cover edge portion part insertion, positioning a cover central wall portion exerting a continuous generally transverse outward pressure against said cover edge portion part wall to exert a generally transverse outward sealing pressure by said cover edge portion part wall against said abutted engagement ring U-shaped portion wall and by said abutting engagement ring inverted U-shaped portion wall against said inner side of said container sidewall.

62. In a method as defined in claim 55 in which said step of telescoping an engagement ring includes telescoping an inverted U-shaped portion of said engagement ring downwardly over said upper edge portion of said upwardly open container sidewall and positioning a U-shaped portion extending generally transversely inwardly from said inverted U-shaped portion; in which said step of inserting a cover includes positioning said cover edge portion overlying said engagement ring U-shaped portion; and in which said step of during said cover insertion, transversely interengaging said flange of said cover edge portion beneath said flange of said engagement ring includes transversely interengaging said flange of said cover edge portion beneath said flange on an inner leg of said engagement ring U-shaped portion.

63. In a method as defined in claim 55 in which said method includes the further step of: during said cover insertion, positioning a cover release flange located at an outer termination of said cover edge portion spaced above said engagement ring accessible by a tool to selectively release said cover edge portion from said flange interengagement with said engagement ring.

64. In a method as defined in claim 55 in which said method includes the further step of: forming each of said container, engagement ring and cover of plastic.

* * * * *